US010057678B2

(12) United States Patent
Kwon et al.

(10) Patent No.: US 10,057,678 B2
(45) Date of Patent: Aug. 21, 2018

(54) MICROSPEAKER ENCLOSURE WITH AIR ADSORBENT IN RESONANCE SPACE

(71) Applicant: EM-TECH. Co., Ltd., Busan (KR)

(72) Inventors: Joong Hak Kwon, Gyeongsangnam-do (KR); Ghi Yuun Kang, Seoul (KR); Hwan Ock Choe, Gyeongsangnam-do (KR)

(73) Assignee: EM-TECH. Co., Ltd., Busan (KR)

( * ) Notice: Subject to any disclaimer, the term of this patent is extended or adjusted under 35 U.S.C. 154(b) by 0 days.

(21) Appl. No.: 15/392,208

(22) Filed: Dec. 28, 2016

(65) Prior Publication Data

US 2017/0188136 A1 Jun. 29, 2017

(30) Foreign Application Priority Data

Dec. 29, 2015 (KR) ..... 10 2015 0188529

(51) Int. Cl.
*H04R 1/28* (2006.01)

(52) U.S. Cl.
CPC ..... *H04R 1/288* (2013.01); *H04R 1/2811* (2013.01); *H04R 1/2819* (2013.01)

(58) Field of Classification Search
CPC .. H04R 1/2811; H04R 1/2819; H04R 1/2823; H04R 1/2842; H04R 1/2846;
(Continued)

(56) References Cited

U.S. PATENT DOCUMENTS 4,356,882 A * 11/1982 Allen ..... H04R 1/2803 181/151
4,657,108 A * 4/1987 Ward ..... H04R 1/2803 181/149
(Continued)

FOREIGN PATENT DOCUMENTS

EP 2003924 A1 12/2008
EP 2424270 B1 5/2014
(Continued)

OTHER PUBLICATIONS

"Zeomics—All Available Zeolite Structures", Computer-Aided Systems Laboratory, Princeton University, Last updated Jul. 31, 2014, Accessed online at http://helios.princeton.edu/zeomics/cgi-bin/list_structures.pl on Dec. 28, 2016.
(Continued)

*Primary Examiner* — Fan Tsang
*Assistant Examiner* — Angelica M McKinney
(74) *Attorney, Agent, or Firm* — Murphy, Bilak & Homiller, PLLC

(57) ABSTRACT

The present invention aims to provide a microspeaker with enhanced low frequency characteristics, by arranging an adsorbent for adsorbing the air in a resonance space and defining a virtual back volume by the air adsorption of the adsorbent. According to an aspect of the present invention, there is provided a microspeaker enclosure with an air adsorbent, including a microspeaker, an enclosure with the microspeaker provided therein, the enclosure defining a resonance space, and an air adsorbent applied to the resonance space of the enclosure, wherein an air adsorption mole ratio per unit volume of the air adsorbent based on a change in the unit pressure is 40.6 mol/m$^3$·atm.

4 Claims, 6 Drawing Sheets

(58) Field of Classification Search
CPC .... H04R 1/2865; H04R 1/2869; H04R 1/288; H04R 1/2884; H04R 1/2888; H04R 1/2892
See application file for complete search history.

(56) References Cited

U.S. PATENT DOCUMENTS

| | | | | |
|---|---|---|---|---|
| 7,953,240 | B2 * | 5/2011 | Matsumura | H04R 1/2803 381/150 |
| 8,292,023 | B2 | 10/2012 | Slotte | |
| 8,335,333 | B2 | 12/2012 | Saiki et al. | |
| 8,687,836 | B2 | 4/2014 | Lin | |
| 8,965,031 | B2 | 2/2015 | Shinyama et al. | |
| 9,430,998 | B2 | 8/2016 | Backman | |
| 2008/0170737 | A1 * | 7/2008 | Saiki | H04R 1/2803 381/346 |
| 2009/0245562 | A1 * | 10/2009 | Saiki | H04R 1/2803 381/345 |
| 2010/0206658 | A1 * | 8/2010 | Slotte | H04R 1/225 181/151 |
| 2010/0329498 | A1 | 12/2010 | Rouvala et al. | |
| 2013/0308812 | A1 | 11/2013 | Shen | |
| 2014/0037119 | A1 | 2/2014 | Yuasa | |
| 2014/0064540 | A1 * | 3/2014 | Lin | H04R 1/2803 381/346 |
| 2015/0072723 | A1 | 3/2015 | Schöffmann et al. | |
| 2015/0358721 | A1 * | 12/2015 | Wang | H04R 1/2811 381/346 |
| 2016/0345090 | A1 | 11/2016 | Wilk et al. | |
| 2017/0353785 | A1 | 12/2017 | Choi et al. | |

FOREIGN PATENT DOCUMENTS

| | | | |
|---|---|---|---|
| JP | 2007288712 | A | 11/2007 |
| KR | 1020070119648 | A | 12/2007 |

OTHER PUBLICATIONS

First, Eric et al., "Zeomics database Zeolite FER", A Computational characterization of zeolite porous networks: an automated approach, Physical Chemistry Chemical Physics, 13(38), 2011, accessed online at http://helios.princeton.edu/zeomics/cgi-bin/view_structure.pl?src=iza&id=FER on May 24, 2017.

Ruthven, D.M., "Characterization of zeolites by sorption capacity measurements", Microporous and Mesoporous Materials, Elsevier, Amsterdam, NL, vol. 22, No. 4-6, Jun. 30, 1998, pp. 537-541.

Wright, J.R., "The Virtual Loudspeaker Cabinet", Journal of the Audio Engineering Society, Audio Engineering Society, New York, NY, US, vol. 51, No. 4, Apr. 2003, pp. 244-247.

"Japan Association of Zeolite (website homepage)", Available online at: http://www.jaz-online.org/introduction/qanda.html. Machine translation by Google Translate attached, 1999, pp. 1-7.

* cited by examiner

MICROSPEAKER ENCLOSURE WITH AIR ADSORBENT IN RESONANCE SPACE

PRIORITY CLAIM

The present application claims priority to Korean Patent Application No. 10-2015-0188529 filed on 29 Dec. 2015, the content of said application incorporated herein by reference in its entirety.

TECHNICAL FIELD

The present invention aims to provide a microspeaker with enhanced properties of low frequency sound, by arranging an adsorbent for adsorbing the air in a resonance space and defining a virtual back volume by the air adsorption of the adsorbent.

BACKGROUND

A microspeaker is provided in a portable device, etc. to generate sound. With recent developments of mobile devices, the microspeaker has been used for various devices. In particular, the latest mobile device tends to have a light weight, small size, and slim shape to facilitate portability, and accordingly, the microspeaker mounted in the mobile device is required to have a small size and slim shape.

However, in the case of a microspeaker having a small size and slim shape, an area of a diaphragm decreases, and a size of a resonance space in which the sound generated by vibration of the diaphragm is resonated and amplified also decreases, as a result of which a sound pressure level (SPL) decreases. Such decrease in the sound pressure level is particularly pronounced at low frequencies. There has been developed a technology of improving a low frequency sound pressure level, by arranging an air adsorbent in a resonance space, so that the air adsorbent adsorbs air molecules and defines a virtual acoustic space, to enhance a low frequency sound pressure level.

EP 2 424 270 B1 discloses arranging a zeolite material in a resonance space as an adsorbent, wherein a mass ratio of silicon composing zeolite particles to aluminum is at least 200.

In addition, U.S. Pat. No. 8,687,836 B2 discloses adopting silicon-based zeolite, which contains a small amount of second metal on a silicon basis, as an air adsorbent material in an enclosure, wherein a mass ratio of silicon to the second metal is equal to or less than 200.

EP 2 424 270 B1 discloses arranging a zeolite material in a resonance space as an adsorbent, wherein a mass ratio of silicon composing zeolite particles to aluminum is at least 200.

However, the technologies disclosed in EP 2 424 270 B1 and U.S. Pat. No. 8,687,836 B2 do not consider that, when the adsorbent is arranged in the resonance space to define the virtual acoustic space, the actual resonance space decreases as much as the space occupied by the adsorbent.

SUMMARY

An object of the present invention is to provide a microspeaker with improved vibration properties at low frequencies, by considering a ratio of a space occupied by an adsorbent to an actual resonance space left, when the adsorbent is arranged in the resonance space.

According to an aspect of the present invention, there is provided a microspeaker enclosure with an air adsorbent, including a microspeaker, an enclosure with the microspeaker provided therein, the enclosure defining a resonance space, and an air adsorbent applied to the resonance space of the enclosure, wherein an air adsorption mole ratio per unit volume of the air adsorbent based on a change in the unit pressure is 40.6 mol/m$^3$·atm.

In some embodiments, the ratio of the air to the volume of the air adsorbent applied to the enclosure satisfies $$V_a > \frac{DV_n \Delta PRT}{P_0}.$$

Also, in some embodiments, a change in the pressure of the enclosure takes into account an effective diaphragm area of the speaker and a mechanical maximum allowable amplitude of the diaphragm, and a maximum value of the change in the pressure of the enclosure satisfies $$(\Delta P)_{max} = -\frac{P_0 S_d X_{mech}}{V_{cc}}.$$

Further, in some embodiments, when the effective diaphragm area of the microspeaker is equal to or greater than 1.2 cm$^2$ and the maximum allowable amplitude is 0.4 mm, $V_a/V_n$ is equal to or greater than 0.1.

The microspeaker enclosure with the air adsorbent according to the present invention can substantially improve a sound pressure level in a low frequency range, as compared with an enclosure without an air adsorbent, by considering a change in the equivalent stiffness based on an air adsorption rate of the air adsorbent arranged in the resonance space and defining an air adsorption mole ratio per unit volume of the air adsorbent.

Moreover, the microspeaker enclosure with the air adsorbent according to the present invention can substantially improve a sound pressure level in a low frequency range, as compared with an enclosure without an air adsorbent, by considering a ratio of the space occupied by the air adsorbent to the space occupied by the air in the application of the air adsorbent.

Those skilled in the art will recognize additional features and advantages upon reading the following detailed description, and upon viewing the accompanying drawings.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION

Hereinafter, an embodiment of a microspeaker enclosure with an air adsorbent in a resonance space according to the present invention will be described in detail with reference to the accompanying drawings.

Figure 1:
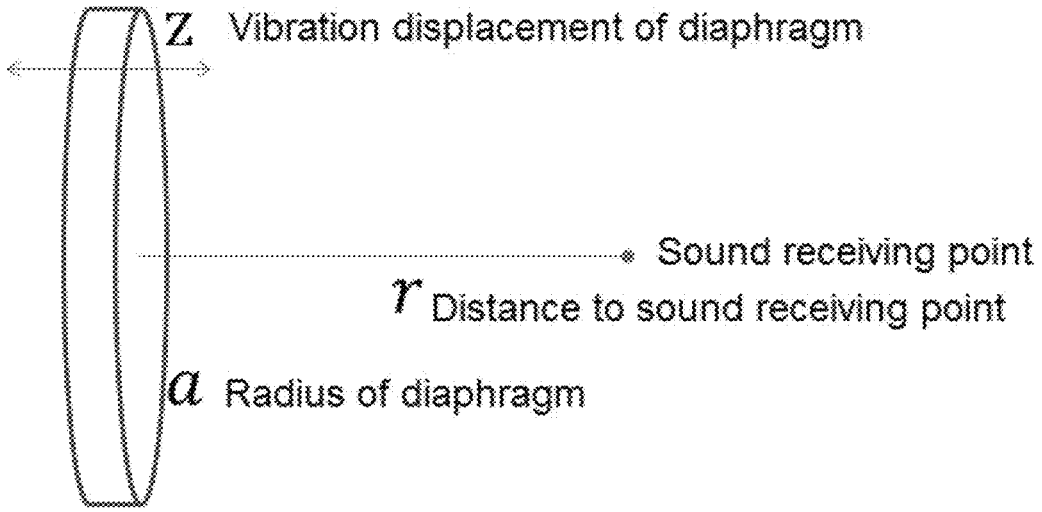
FIG. 1 is a schematic view illustrating vibration characteristic factors of a diaphragm associated with a sound pressure level that determine the sound pressure level.

FIG. 1 is a schematic view illustrating vibration characteristic factors of a diaphragm associated with a sound pressure level that determine the sound pressure level. When it is assumed that a vibration displacement of the diaphragm is Z, a distance from the diaphragm to a sound receiving point is r, a radius of the diaphragm is a, a vibration frequency of the diaphragm is f, and an air density is $\rho_0$, a sound pressure P can be expressed as follows:

$$|P| = \left\{(2\pi f)^2 \frac{\rho_0 a^2}{2r}\right\}|z| \quad \text{(Equation 1.1)}$$

Figure 2:
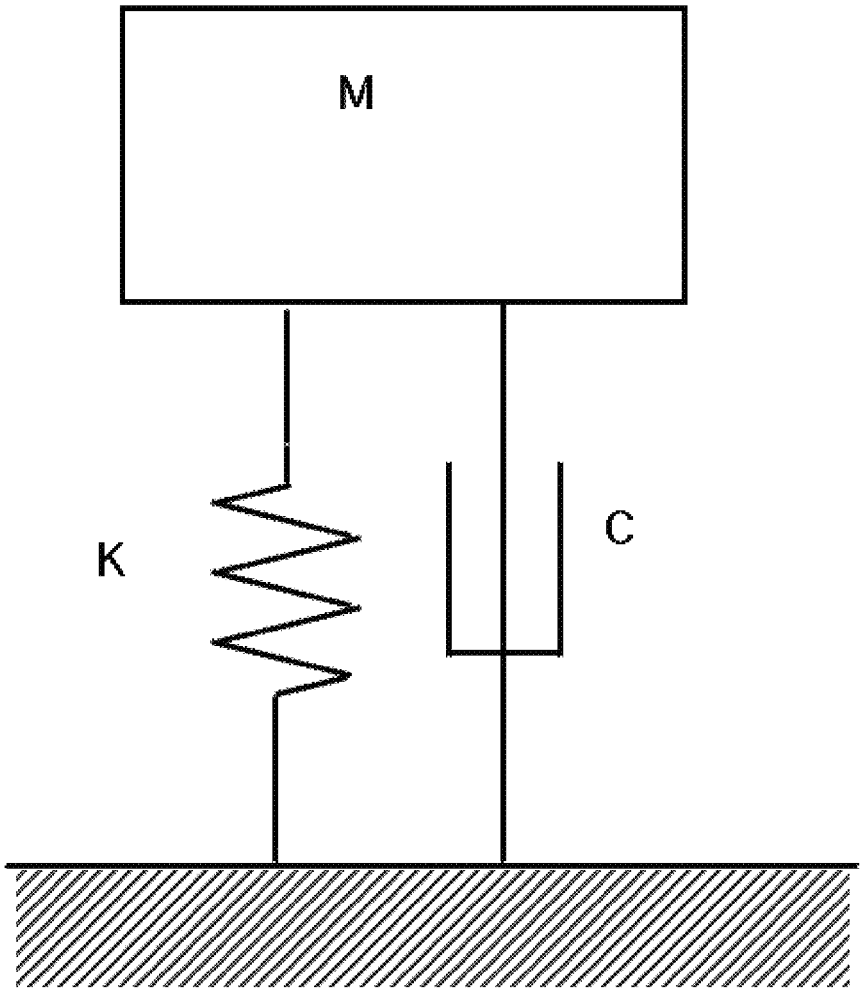
FIG. 2 is a view illustrating a movement of a vibration system of a microspeaker using a primary induction system.

FIG. 2 is a view illustrating a movement of a vibration system of the microspeaker using a primary induction system. When it is assumed that M denotes a weight of the vibration system including a diaphragm, a voice coil, etc., C denotes attenuation of the vibration system, K denotes stiffness of the vibration system, and F denotes an electromagnetic force generated in the coil, the vibration displacement Z of the diaphragm can be expressed as follows:

$$Z = \frac{F}{\sqrt{(K - M\omega^2)^2 + (C\omega)^2}} \quad \text{(Equation 2.1)}$$

$$\omega = 2\pi f$$

Here, if a vibration frequency ω is lower than a resonant frequency, the vibration displacement is significantly influenced by the stiffness K of the vibration system as follows:

$$Z = \frac{F}{\sqrt{(K - M/\omega^2)^2 + (C/\omega)^2}} = \frac{F}{K} \quad \text{(Equation 2.2)}$$

Figure 3:
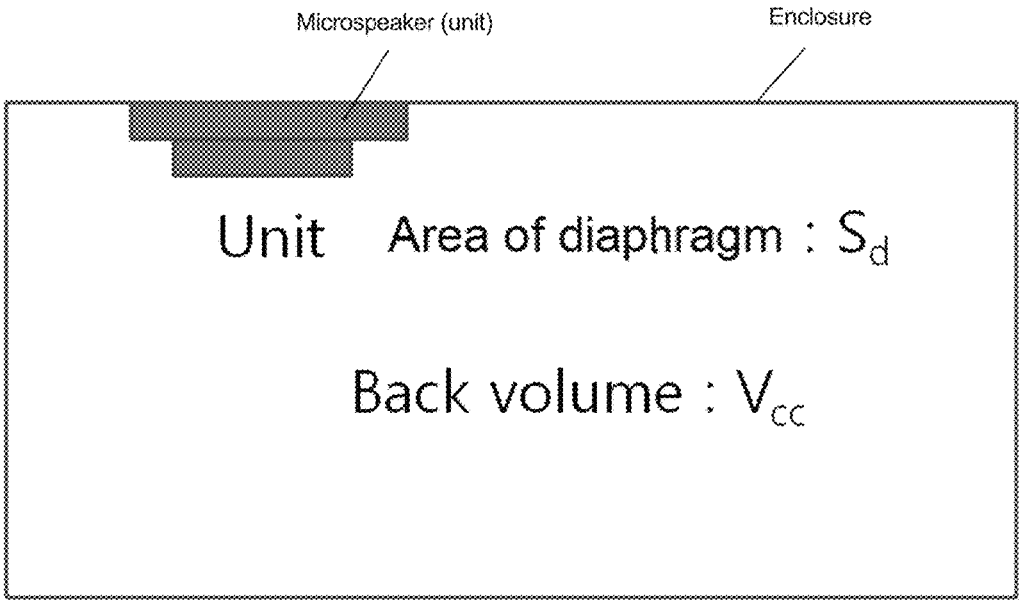
FIG. 3 is a schematic view for the calculation of the equivalent stiffness of a box space where a microspeaker is provided in an enclosure.

FIG. 3 is a schematic view for the calculation of the equivalent stiffness of a box space where a microspeaker is provided in an enclosure.

When the microspeaker is provided in the enclosure, a resonance space (back volume) in the box-shaped enclosure serves as another stiffening element to thereby increase stiffness of a speaker system, and the total stiffness of the microspeaker enclosure ($K_{total}$) is the sum of the stiffness of the microspeaker ($K_{unit}$) and the equivalent stiffness of the resonance space ($K_{cc}$), which can be expressed by $K_{total}=K_{unit}+K_{cc}$.

Here, when it is assumed that an area of the diaphragm provided in the microspeaker is $S_d$ and a volume of the resonance space in the enclosure with the microspeaker provided therein is $V_{cc}$, stiffness $K_{cc}$ increased due to the resonance space of the enclosure can be expressed by:

$$K_{cc} = \frac{\rho_0 c^2 S_d^2}{V_{cc}}. \quad \text{(Equation 3.1)}$$

The equivalent stiffness of the space in the enclosure at a low capacity can be demonstrated as follows.

In the case of a constant temperature, the product of the pressure and volume of the space in the enclosure has a constant value (ideal gas state equation), which can be expressed by:

$$P_0 V_{cc} = nRT = \text{const.} \quad \text{(Equation 3.2).}$$

As the diaphragm of the speaker moves, the volume of the space in the enclosure changes, so the pressure of the resonance space changes, which can be expressed by:

$$P_0 V_{cc} = (P_0 + \Delta P)(V_{cc} + \Delta V) \quad \text{(Equation 3.3)}$$

$$0 = P_0 \Delta V + \Delta P V_{cc} + \Delta P \Delta V \quad \text{(Equation 3.4)}$$

As the product of a pressure variation and a volume variation is relatively very small, which can be expressed by:

$$\Delta P \Delta V \approx 0,$$

so $$\Delta P V_{cc} = -P_0 \Delta V \quad \text{(Equation 3.5).}$$

A force acting on the diaphragm due to the change in the pressure is proportional to the area of the diaphragm, which can be expressed by:

$$F = S_d \Delta P \quad \text{(Equation 3.6)}$$

$$\Delta P = \frac{F}{S_d}.$$

In addition, the change in the volume caused by the movement of the diaphragm can be expressed by the product of the effective diaphragm area and the vibration displacement as given by:

$$\Delta V = S_d z \quad \text{(Equation 3.7)}$$

When the air is used as a medium, an acoustic impedance Z can be expressed by:

$$Z = \frac{P_0}{c} = \rho_0 c \quad \text{(Equation 3.8)}$$

$$P_0 = \rho_0 c^2,$$

which can be organized again as:

$$\Delta P V_{cc} = -P_0 \Delta V \quad \text{(Equation 3.9)}$$

$$\left(\frac{F}{S_d}\right) V_{cc} = -(\rho_0 c^2)(S_d z)$$

$$F = -\frac{\rho_0 c^2 S_d^2}{V_{cc}} z.$$

The equivalent stiffness of the resonance space (back volume) can be organized according to the Hooke's law, which can be expressed by:

$$K_{cc} = \frac{\rho_0 c^2 S_d^2}{V_{cc}}. \quad \text{(Equation 3.1)}$$

Therefore, when the volume of the resonance space decreases, the equivalent stiffness of the air increases and the low frequency sound pressure level decreases.

In the case of a material used as an air adsorbent, an air adsorption amount is proportional to the pressure.

Figure 4:
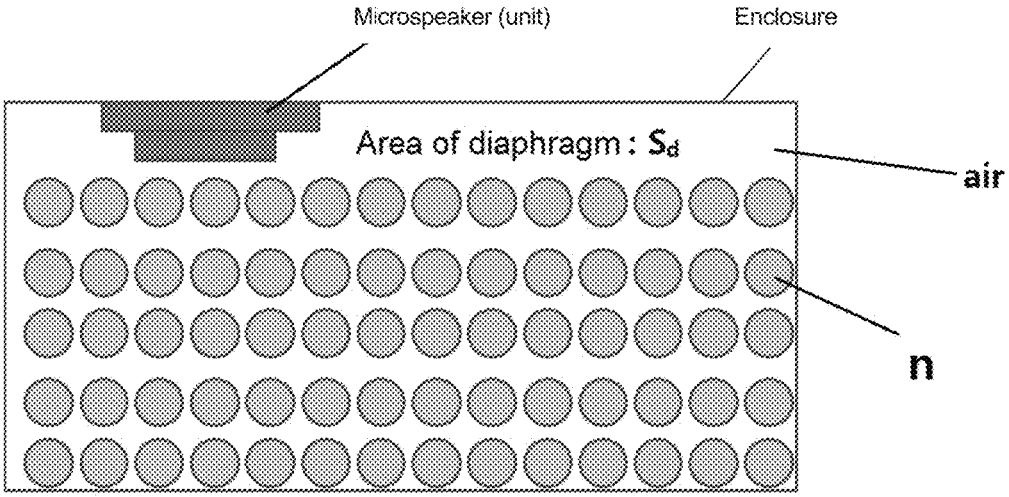
FIG. 4 is a schematic view illustrating a state where an air adsorbent is filled in the enclosure with the microspeaker provided therein.

FIG. 4 is a schematic view illustrating a state where the air adsorbent is filled in the enclosure with the microspeaker provided therein.

The microspeaker (unit) is provided in the enclosure, the resonance space (back volume) of the enclosure is filled with a certain amount of air adsorbent n, and the remaining space is occupied by the air. The total volume $V_{cc}$ of the resonance space is divided into a volume $V_a$ occupied by the air and a volume $V_n$ occupied by the adsorbent, which can be expressed by:

$$V_{cc}=V_a+V_n \quad \text{(Equation 4.1)},$$

and according to the ideal gas state equation, which can be expressed by:

$$P_0V_a=n_0RT \quad \text{(Equation 4.2)},$$

the air adsorption amount based on the change in the pressure can be expressed by:

$$\Delta n=DV_n\Delta P \quad \text{(Equation 4.3)}.$$

As the pressure changes in response to a change in the volume caused by a change in the amplitude of the diaphragm, and at this time, the air mole number in the space changes due to a change in the adsorption amount of the air adsorbent, which can be expressed by:

$$P_0V_a=n_0RT$$

$$(P_0+\Delta P)(V_a+\Delta V)=(n_0-\Delta n)RT$$

$$(P_0+\Delta P)(V_a+\Delta V)=(n_0-DV_n\Delta P)RT$$

$$P_CV_a+\Delta PV_a+P_C\Delta V+\Delta P\Delta V=n_CRT-DV_n\Delta PRT \quad \text{(Equation 4.4)}.$$

As the product of a pressure variation and a volume variation is relatively very small, it can be organized as follows:

$$\Delta P\Delta V\cong 0$$

$$\Delta PV_a+P_0\Delta V=-DV_n\Delta PRT$$

$$\Delta P(V_a+DV_nRT)=-P_0\Delta V \quad \text{(Equation 4.5)}.$$

The force acting on the diaphragm due to the change in the pressure is associated with the area of the diaphragm, which can be expressed by:

$$F = S_d\Delta P \quad \text{(Equation 3.6)}$$

$$\Delta P = \frac{F}{S_d}$$

The change in the volume caused by the movement of the diaphragm is expressed by the product of the effective diaphragm area and the vibration displacement, which can be expressed by:

$$\Delta V=S_dz \quad \text{(Equation 3.7)}.$$

When the air is used as a medium, the acoustic impedance Z can be expressed by:

$$Z = \frac{P_0}{c} = \rho_0 c \quad \text{(Equation 3.8)}$$

$$P_0 = \rho_0 c^2,$$

which can be organized again as:

$$\Delta P(V_a + DV_nRT) = -P_0\Delta V \quad \text{(Equation 4.6)}$$

$$\left(\frac{F}{S_d}\right)(V_a + DV_nRT) = -(\rho_0 c^2)(S_d z)$$

$$F = -\frac{\rho_0 c^2 S_d^2}{(V_a + DV_nRT)}z.$$

The equivalent stiffness of the resonance space (back volume) can be organized according to the Hooke's law, which can be expressed by:

$$K_{cc} = \frac{\rho_0 c^2 S_d^2}{(V_a + DV_nRT)}. \quad \text{(Equation 4.7)}$$

In comparison of the equivalent stiffness before and after the application of the air adsorbent to the enclosure, the equivalent stiffness before the application of the adsorbent can be expressed by:

$$K_{cc} = \frac{\rho_0 c^2 S_d^2}{V_{cc}}, \quad \text{(Equation 3.1)}$$

and the equivalent stiffness after the application of the adsorbent can be expressed by:

$$\frac{\rho_0 c^2 S_d^2}{(V_a + DV_nRT)}. \quad \text{(Equation 4.7)}$$

Thus, in order to ensure that the low frequency sound is more enhanced in the application of the air adsorbent than in the non-application of the air adsorbent, the following conditions are satisfied:

$$V_{cc}<V_a+DV_nRT,$$

$$V_a+V_n<V_a+DV_nRT$$

$$V_n<DV_nRT \quad \text{(Equation 4.8)}.$$

That is to say, in the application of the air adsorbent, a minimum value of the air adsorption rate required to enhance the low frequency sound can be expressed by:

$$V_n < DV_nRT \quad \text{(Equation 4.9)}$$

$$D > \frac{1}{RT}.$$

Under the conditions such as a gas constant of the air and a normal temperature, when it is assumed that the gas constant R is $8.21\times10^{-5}$ $m^3$·atm/mol·K and the normal temperature is 300K, D>40.6 mol/$m^3$·atm.

Therefore, the minimum value of the variation rate of the adsorption amount based on the change in the pressure per unit volume is 40.6 mol/$m^3$·atm.

Meanwhile, the microspeaker (unit) is provided in the enclosure, the resonance space (back volume) of the enclosure is filled with a certain amount of air adsorbent n, and the remaining space is occupied by the air. When the total volume $V_{cc}$ of the resonance space is divided into a volume $V_a$ occupied by the air and a volume $V_n$ occupied by the adsorbent, an air adsorption mole number per unit volume based on the change in the pressure is D, and an initial air mole number is $n_0$, an air adsorption amount based on the change in the pressure can be expressed by:

$$\Delta n = DV_n\Delta P \quad \text{(Equation 5.1).}$$

Here, as the air adsorption amount cannot exceed the initial air mole number, the following condition is satisfied:

$$n_0 > DV_n\Delta P \quad \text{(Equation 5.2).}$$

The initial mole number no can be expressed by:

$$P_0V_a = n_0RT$$

$$n_0 = \frac{P_0V_a}{RT},$$

which can be organized again as:

$$n_0 > DV_n\Delta P \quad \text{(Equation 5.3)}$$

$$\frac{P_0V_a}{RT} > DV_n\Delta P$$

$$V_a > \frac{DV_n\Delta PRT}{P_0}.$$

Taking into account a mechanical maximum amplitude $X_{mech}$, which is a maximum displacement of the diaphragm which does not have a physical contact, as one of the TS parameters of the speaker, a maximum pressure change can be expressed as follows:

$$(\Delta P)_{max}(V_a + DV_nRT)_{min} = -P_0(\Delta V)_{max} \quad \text{(Equation 5.4)}$$

$$(\Delta P)_{max}(V_a + DV_nRT)_{min} = -P_0(S_dX_{mech})$$

$$(V_a + DV_nRT)_{min} = V_{cc}$$

$$(\Delta P)_{max} = -\frac{P_0S_dX_{mech}}{V_{cc}}$$

$$V_a > \frac{DV_nRT}{P_0}\frac{P_0S_dX_{mech}}{V_{cc}} \quad \text{(Equation 5.5)}$$

$$\frac{V_a}{V_n} > \frac{S_dX_{mech}DRT}{V_{cc}} \quad \text{(Equation 5.6)}$$

Here, when the minimum value of the adsorption mole number D per unit volume based on the change in the pressure is 40.6, and for the sizes of the enclosure and the microspeaker, the resonance space $V_{cc}$, is 0.6 cc, the effective diaphragm area $S_d$ is 1.2 $cm^2$, the maximum allowable amplitude $X_{mech}$ is 0.4 mm, and $$\frac{V_a}{V_n} > 0.08.$$

Figure 5:
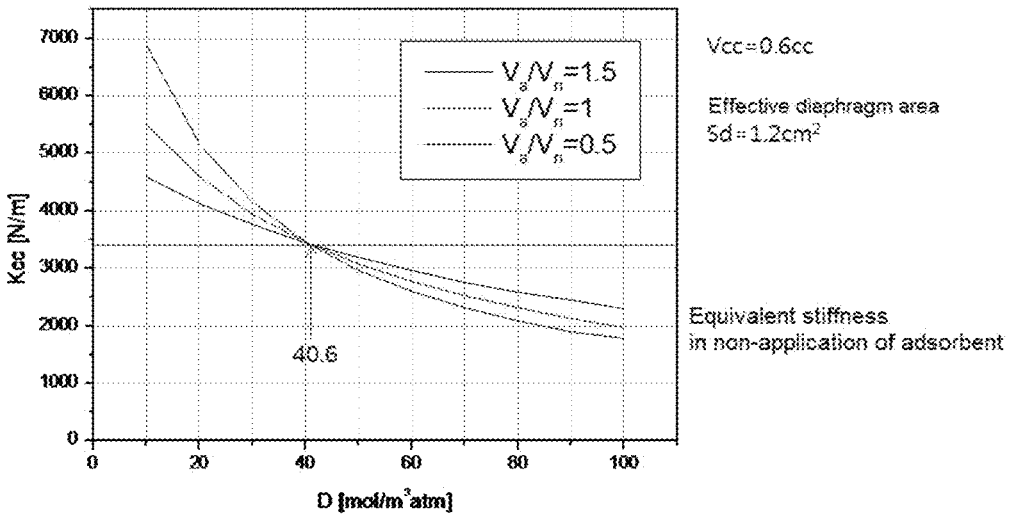
FIG. 5 is a graph showing a change in the equivalent stiffness based on an air adsorption rate of the air adsorbent.

FIG. 5 is a graph showing a change in the equivalent stiffness based on the air adsorption rate of the air adsorbent. Here, for the sizes of the enclosure and the microspeaker, the resonance space $V_{cc}$ is 0.6 cc and the effective diaphragm area $S_d$ is 1.2 $cm^2$. The equivalent stiffness becomes smaller in the application of the air adsorbent than in the non-application of the air adsorbent, when the adsorption rate D per unit volume based on the change in the pressure of the air adsorbent is equal to or greater than 40.6 mol/$m^3$·atm. It can be seen that the equivalent stiffness of the enclosure becomes smaller, when D is equal to or greater than 40.6 mol/$m^3$·atm, regardless of the change in $V_a/V_n$.

Figure 6:
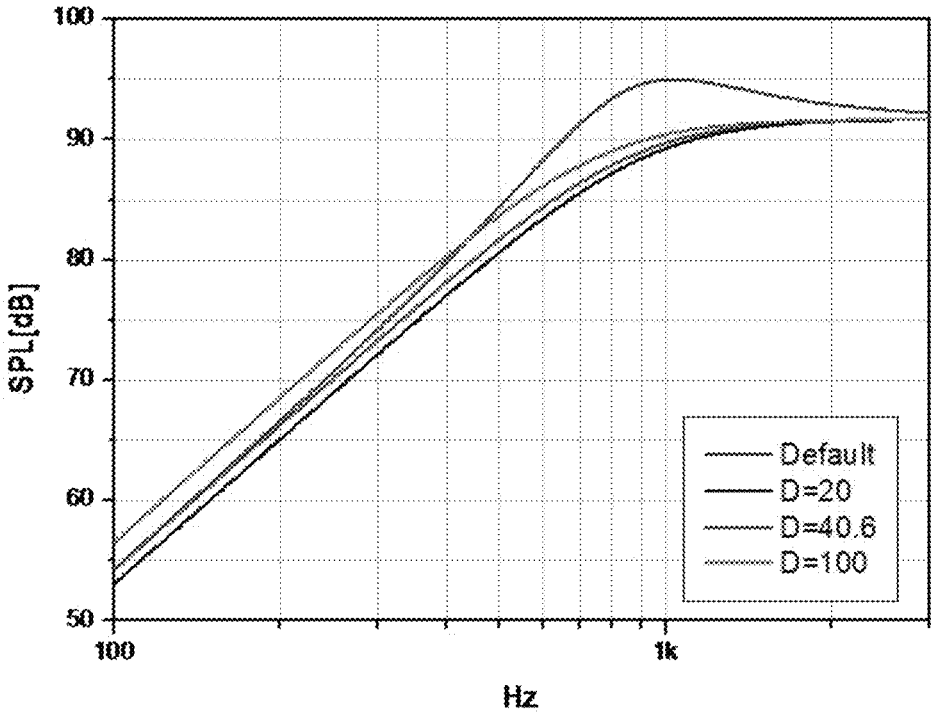
FIG. 6 is a graph showing analysis of low frequency response characteristics based on an air adsorption rate of the air adsorbent.

FIG. 6 is a graph showing analysis of low frequency response characteristics of the speaker based on an adsorption rate of the air adsorbent. Here, for the sizes of the enclosure and the microspeaker, the resonance space $V_{cc}$ is 0.6 cc and the effective diaphragm area $S_d$ is 1.2 $cm^2$.

The low frequency sound pressure level (SPL) is almost the same both in the application of the air adsorbent and the non-application of the air adsorbent, when the air adsorption rate D is 40.6 mol/$m^3$·atm, but the low frequency sound pressure level (SPL) is more remarkably improved in the application of the air adsorbent than in the non-application of the air adsorbent, when D is 100 mol/$m^3$·atm. On the contrary, the low frequency sound pressure level (SPL) becomes lower in the application of the air adsorbent than in the non-application of the air adsorbent, when D is 20 mol/$m^3$·atm, as a result of which it is apparent that D should be at least 40.6 mol/$m^3$ ·atm in the application of the air adsorbent.

Figure 7:
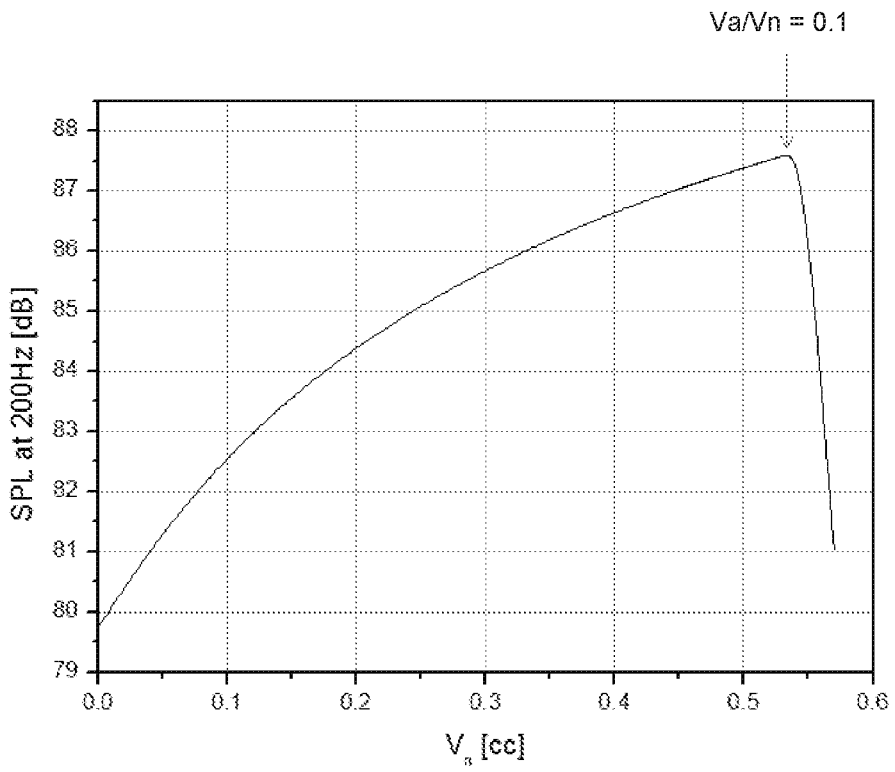
FIG. 7 is a graph showing a change in the low frequency sound pressure level based on a ratio of the adsorbent applied to the enclosure to pores.

FIG. 7 is a graph showing a change in the low frequency sound pressure level based on a ratio of the adsorbent applied to the enclosure to pores. The change in the sound pressure level based on the volume $V_n$ has been measured and illustrated, when the resonance space $V_{cc}$ of the enclosure is 0.6 cc, the effective diaphragm area $S_d$ is 1.2 $cm^2$, and the adsorption rate D is 225 mol/$m^3$·atm. The sound pressure level increases as the volume $V_n$ increases, until $V_a/V_n$ reaches 0.1, but the sound pressure level starts to decrease when $V_a/V_n$ drops below 0.1. That is to say, the volume occupied by the air in the resonance space of the enclosure should be at least 10% of the space occupied by the adsorbent.

As used herein, the terms "having", "containing", "including", "comprising" and the like are open-ended terms that indicate the presence of stated elements or features, but do not preclude additional elements or features. The articles "a", "an" and "the" are intended to include the plural as well as the singular, unless the context clearly indicates otherwise.

With the above range of variations and applications in mind, it should be understood that the present invention is not limited by the foregoing description, nor is it limited by the accompanying drawings. Instead, the present invention is limited only by the following claims and their legal equivalents.

What is claimed is:

1. A microspeaker enclosure, comprising:

a microspeaker;

an enclosure with the microspeaker provided in the enclosure, the enclosure defining a resonance space; and an air adsorbent applied to the resonance space of the enclosure, wherein an air adsorption rate of the air adsorbent is defined as an air adsorption mole number per unit volume of the air adsorbent based on a change in pressure, wherein the air adsorption rate of the air adsorbent is greater than 40.6 mol/$m^3$·atm, wherein a ratio of air to volume of the air adsorbent applied to the enclosure satisfies $$V_a > \frac{DV_n \Delta PRT}{P_0},$$

where $V_a$, is a volume occupied by the air in the resonance space, $V_n$ is a volume occupied by the air adsorbent in the resonance space, D is the air adsorption rate of the air adsorbent, R is a gas constant, T is temperature, $P_0$ is an initial pressure, and ΔP is a pressure variation.

2. The microspeaker enclosure of claim 1, wherein a change in the pressure of the enclosure takes into account an effective diaphragm area of the microspeaker and a maximum allowable mechanical amplitude of a diaphragm provided in the microspeaker, and wherein a maximum value of the pressure variation in the enclosure satisfies $$(\Delta P)_{max} = -\frac{P_0 S_d X_{mech}}{V_{cc}},$$

where ΔP is a pressure variation, $P_0$is an initial pressure, $S_d$ is an area of the diaphragm provided in the microspeaker, $X_{mech}$ is the maximum allowable mechanical amplitude of the diaphragm provided in the microspeaker, and $V_{cc}$ is a volume of the resonance space of the enclosure.

3. The microspeaker enclosure of claim 2, wherein when the effective diaphragm area of the microspeaker is equal to or greater than 1.2 $cm^2$ and the maximum allowable amplitude is 0.4 mm, $V_a/V_n$ is equal to or greater than 0.1.

4. The microspeaker enclosure of claim 1, wherein when an effective diaphragm area of the microspeaker is equal to or greater than 1.2 $cm^2$ and a mechanical maximum allowable amplitude of a diaphragm provided in the microspeaker is 0.4 mm, $V_a/V_n$ is equal to or greater than 0.1.

* * * * *